United States Patent [19]

Morse

[11] 4,036,390

[45] July 19, 1977

[54] PLASTIC TANK PANELS AND JOINT ASSEMBLY

[75] Inventor: Dwain E. Morse, Ventura County, Calif.

[73] Assignee: Morse California Co., Fillmore, Calif.

[21] Appl. No.: 623,316

[22] Filed: Oct. 17, 1975

[51] Int. Cl.[2] ..... B65D 7/02; B65D 7/42

[52] U.S. Cl. ..... 220/5 A; 220/1 B; 220/83

[58] Field of Search ..... 220/1 B, 5 R, 5 A, 75, 220/76, 83; 52/248

[56] References Cited

U.S. PATENT DOCUMENTS

| | | | |
|---|---|---|---|
| 1,169,022 | 1/1916 | Eldridge et al. | 220/5 R X |
| 2,143,436 | 1/1939 | Edgin et al. | 220/5 R |
| 3,460,705 | 8/1969 | Green | 220/1 B X |
| 3,700,512 | 10/1972 | Pearson et al. | 220/5 A X |

*Primary Examiner*—William Price
*Assistant Examiner*—Steven M. Pollard
*Attorney, Agent, or Firm*—Spensley, Horn & Lubitz

[57] ABSTRACT

A curved wall panel made of fiberglass-polyester resin composite and having a main wall section, in which steel straps (or other high modulars or high stiffner material straps) are circumferentially embedded, and an inwardly recurved section at each side thereof which terminates in a radially disposed and outwardly extending flange. The side-by-side flanges of adjacent panels are conjoined to form a joint which is outwardly spaced from the pair of flanges. The plastic portions of the bolted butt joint formed thereby are in compression only from the bolts and from the hydrostatic pressure while the steel bolts and straps are in tension only. A plurality of conjoined ring panels form a ring module. Outwardly disposed ring panels at the top and bottom of each wall panel enable a ring module to be placed on the rim section of a base formed of pie-shaped elements and to be stacked to form a field-erected tank having horizontally disposed and movement-permitting ring joints above and beneath each ring module. Because the thin-walled, creep-susceptible composite in the compressed butt joints and in the ring joints are not under tensile stress, there is substantially no stress concentration nor loci for accelerated corrosion in the tank, so that any size tank can be precisely designed and fabricated.

42 Claims, 13 Drawing Figures

PLASTIC TANK PANELS AND JOINT ASSEMBLY

BACKGROUND OF THE INVENTION

1. Field of the Invention

This invention relates to the structural loading of materials having large differences in their moduli of elasticity. It particularly relates to panels comprising a composite system of steel bands laminated into fiberglass-polyester sheets. It further relates to butt joints for conjoining and interconnecting such panels. It additionally relates to modular construction of storage tanks by conjoining fiberglass panels with creep-resistant joints therebetween.

2. Review of the Prior Art

Storage tanks are very common types of equipment in the chemical and allied industries for accumulating reserve stocks of raw materials against a disturbance in regular deliveries or because shipment is periodical and in large quantity. In addition, storage tanks are used for intermediate storage in a process or for storage of a product. If a tank serves as one of the steps in a manufacturing process, it is designated a process tank, such as dissolving tanks, blending tanks, and feeding tanks, and may include other functions such as thickening, settling, clarifying, and fermenting. Tanks built at grade are of flat-bottom type and may rest on a foundation of sand or on both sand and a curbing of concrete slightly larger than the tank diameter.

In addition to such liquids as water, brine, acid solutions, caustic solutions, wood pulps, mining pulps, petroleum, naphtha, gasoline, and drilling muds that are commonly stored in storage and process tanks, flowable solids can also be stored therein and can similarly generate hydrostatic heads. Such flowable solids include grains, flour, powdered coal, fertilizer, powdered sulfur, sugar, salt, and various other powdered and particulate products.

Most tanks are made of steel, but corrosion-resistant tanks have frequently been made from thin-walled composite materials such as a composition containing a phenolformaldehyde resin and an acid-digested asbestos fiber or graphite. Such tanks resist the action of any acid and of many salt solutions. They are tough, strong, and impact resistant and resist sustained temperatures of 265° F (130° C).

During recent years, composite panels constructed of fiberglass and polyester resin have become widely used and highly preferred. Fiberglass-polyester resin has been used in the manufacture and installation of storage tanks because of its excellent resistance to a wide range of chemicals, good impact strength, and light weight.

Unfortunately, random-chopped fiberglass-resin composite panels have a tendency to creep under heavy loads over long periods of time. This slow movement creates stress concentrations, particularly near the bottom sides and at the joints or butted edges of a tank under load. Because of the concentrated loads at such places, there is a distinct possibility of eventual failure of the plastic structure. Furthermore, it is known that when reinforced polyester and epoxy resins are placed in contact with liquids over a long period of time, there is a gradual reduction in tensile strength. Designers are forced, by these characteristics of the reinforced panels that are currently in the market, to design and fabricate under considerable uncertainty and with exaggerated safety features.

Non-pressurized storage and process tanks create unique design problems because of uneven loading of the walls and the wall intercepts in accordance with the pressure created by the head of the liquid therein. When a tank is filled with liquid, there is no pressure at the top and maximum pressure at the bottom along the sides of the tank. Consequently, stretching along the walls is greatest near the bottom and makes the bottom circumference greater than the circumference of the base or of the top of the tank. Because of such concentrated stretching and bending, stress concentrations are also greatest near the bottom of the tank, and higher stress means accelerated corrosion, as indicated in FIGS. 1 and 2 of the drawings.

Another design factor arises because hydrostatic pressure tends to force the sides of a tank to assume a prefectly round shape. Therefore, any configuration, such as a field-assembled joint, that is not aligned along the circumference of a circle creates concentrated bending and stretching.

All joints under loads will generate stress concentrations and thus accelerate corrosion, especially in field-erected tanks constructed from thin-walled, creep-susceptible panels. During modular erection of a tank on site, the curved panels are generally assembled with a lap joint, a bolted butt joint, or a welded butt joint. As the walls of the tank increase in diameter because of stretching by hydrostatic pressure, the bends straddling a bolted butt joint particularly tend to become straightened out by the pressure exerted along the walls and become loci of accelerated corrosion, as indicated in FIG. 3. Furthermore, added fixtures in a tank wall, such as a valve or hatch, create stress concentrations at the opening in the wall because the opening can bear no load and must transmit its share of the load to the adjoining wall above and beneath its sides, as indicated in FIG. 4.

It is recognized that any material stretches at a rate defined by its modulus of elasticity. A fiberglass-resin composite of randomly oriented short fiber construction stretches approximately 30 times per unit area more than steel under any given load. Steel and fiberglass bonded in a plastic composite will stretch at a rate that is defined by their composite modulus of elasticity, i.e., whether the force is considered to be exerted on the steel or on the composite or on both, the movement will be the same.

SUMMARY OF THE INVENTION

The object of this invention is to provide a steel-fiberglass resin storage tank that is not susceptible to creep.

It is another object to provide a steel-fiberglass resin storage tank that will not deteriorate because of stress concentrations.

It is an additional object to provide a butt joint, for conjoining steel-fiberglass-resin panels, which will be subjected to substantially no tension from hydrostatic head.

It is a further object to provide a means for accurately balancing and tensioning the load-accepting means for this butt joint.

It is also an object to provide a steel-fiberglass resin storage tank having a reinforcing means which will permit design and fabrication without uncertainty and/or the exaggerated safety features necessary in fiberglass resin tanks currently in the market.

It is another important object to provide a method of fabricating any size storage tank to a given safety factor.

It is still another important object to provide a bottom or base for a storage tank which forms an expansion joint with the lower most ring module and relieves bending stresses.

In accordance with these objects and the spirit of this invention, a modular-construction tank is provided which is fabricated from thin-walled, creep-susceptible materials such as reinforced plastics, particularly fliberglass-polyester plastics. The tank comprises a base, one or more ring modules which are vertically stacked on top of the base, and, selectively, a top.

The ring modules are constructed from a plurality of curved wall panels which are interconnected along each vertical seam with a butt joint free of tension comprising straps of a relatively rigid and non-stretchable material, such as steel. The straps are attached to and embedded within each panel. The ends of the straps are interconnected by means of a rigid member extending across the vertical seam, such as a pair of steel bolts. The panels on each side of the butt joint diverge from the straps, in pairs, as inwardly recurved portions which terminate in adjacent radially disposed and outwardly extending flanges, thus creating a paired shape in section that is somewhat like the number "7". The straps are tightened across the butt joint by taking up the bolts to put the joint into circumferentially directed compression or at least free of tension.

While the tank is empty, the ends of the flanges are spaced inwardly from the bolts, but as the tank is filled and the curved wall panels receive an outwardly directed pressure load, the ends of the flanges move outwardly until they contact and receive support from the bolts. The pressure within the tank tends to bend the pair of recurved portions outwardly and straighten them so that a cam action occurs that squeezes the flanges even more tightly together.

The base comprises a raised central section and a low rim section which are joined by a recurved perimeter section extending from the upper surface of the central section to the rim section and comprising two expansion bends. The curved wall panels of each ring module have horizontally disposed flanges along their top and bottom sides with the bottom flanges having downward edges.

The lowermost ring module is conjoined to the base with a movement-permitting base joint. Its bottom curved wall panel rests upon the rim of the base, forming in combination therewith a bottom knuckle expansion joint. This joint eliminates bending moments that would otherwise be generated at the juncture of the bottom of the curved wall panel and the base if connection therebetween were totally immobile.

The ring modules are conjoined by a circumferential or horizontal joint that is relieved from stress concentrations by the designs of the curved panels of each module. The bottom flange of the curved wall panels are slightly wider than the top flange of the curved wall panels upon which they rest so that when one wall panel is in position on top of a second wall panel, the downward edge extends over the circumferential or horizontal joint.

The top, as well as the base, can be in two or several pie-shaped panels, depending upon the size thereof and the on-site handling facilities. Because the base rests on the ground and cannot move downwardly under pressure and because the top is not under pressure, a movement-permitting joint is not needed between the pie-shaped panels of either. The pie-shaped panels of the top do, however, have an outwardly disposed arcuate face along their outermost edge. This arcuate face rests upon the top flanges of the curved wall panels of the topmost ring module.

The tanks of this invention are suitable for use as storage tanks and as process tanks and can be constructed in any size indicated by design calculations for the component materials. These tanks are principally intended to be field erected from factory-constructed curved wall panels, using a permanent sealant for all joints. However, they can be satisfactorily constructed with gaskets in all joints for temporary use, such as for large drums that are suitable for one-way shipment and disassembled return.

DESCRIPTION OF THE PREFERRED EMBODIMENT

Figure 1:
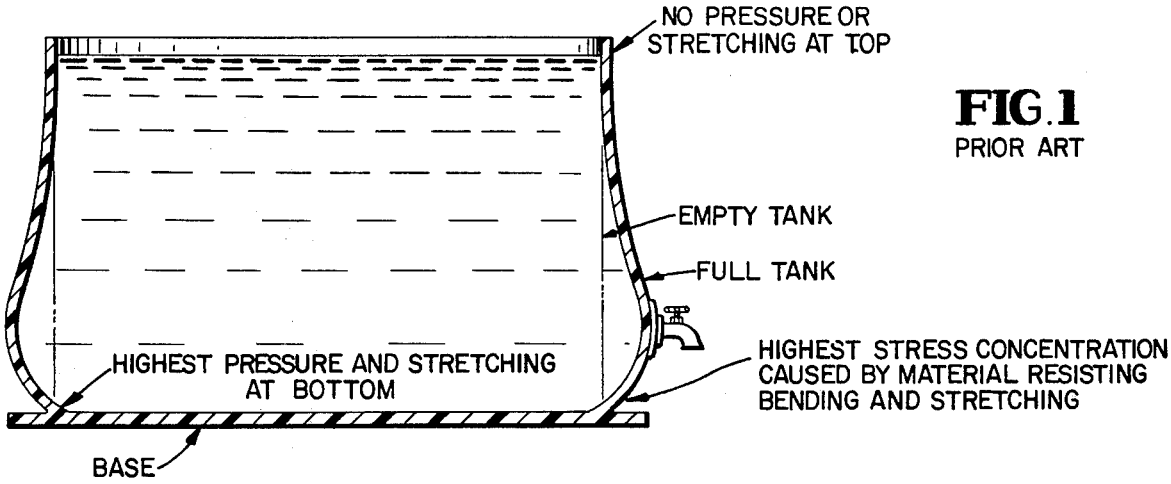
FIG. 1 PRIOR ART
FIG. 1 shows in sectional elevation a filled tank of the prior art whose walls have been stretched by hydrostatic pressure.
Figure 2:
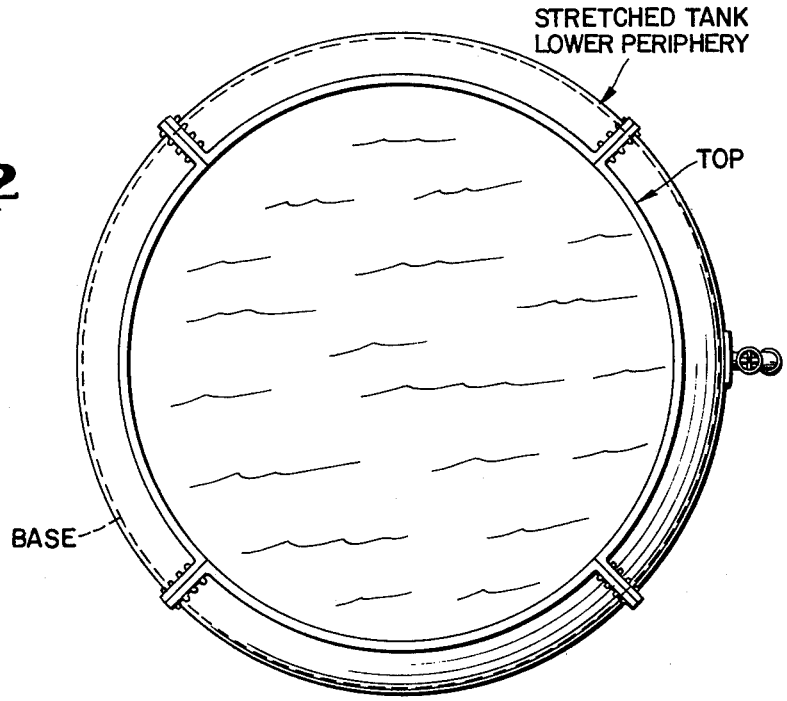
FIG. 2 PRIOR ART
FIG. 2 is a plan view of the filled tank of FIG. 1.
Figure 3:
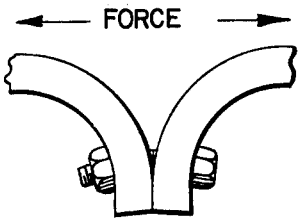
FIG. 3 PRIOR ART
FIG. 3 is an enlarged plan view of one of the butt joints of the tank of FIG. 2.
Figure 4:
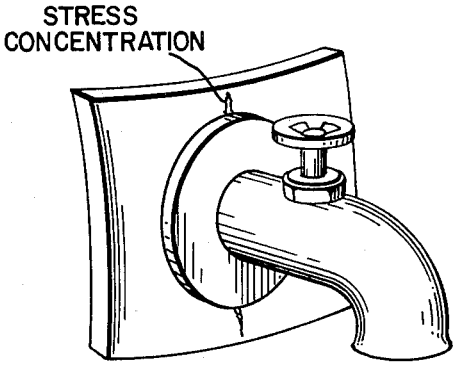
FIG. 4 PRIOR ART
FIG. 4 is an enlarged perspective view of the tank wall and valve shown in FIGS. 1 and 2.
Figure 5:
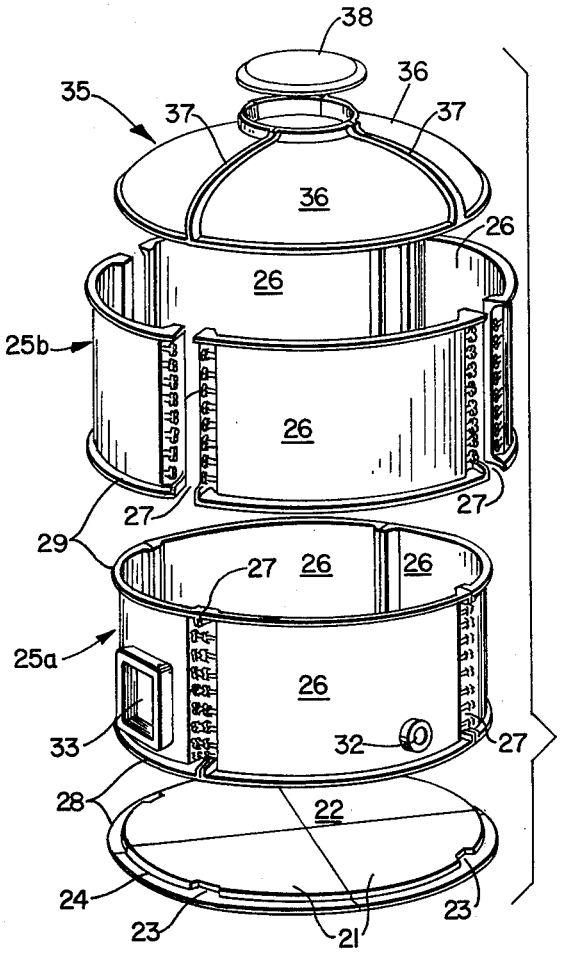
FIG. 5 is an exploded perspective view of a modular-construction tank of this invention.
Figure 12:
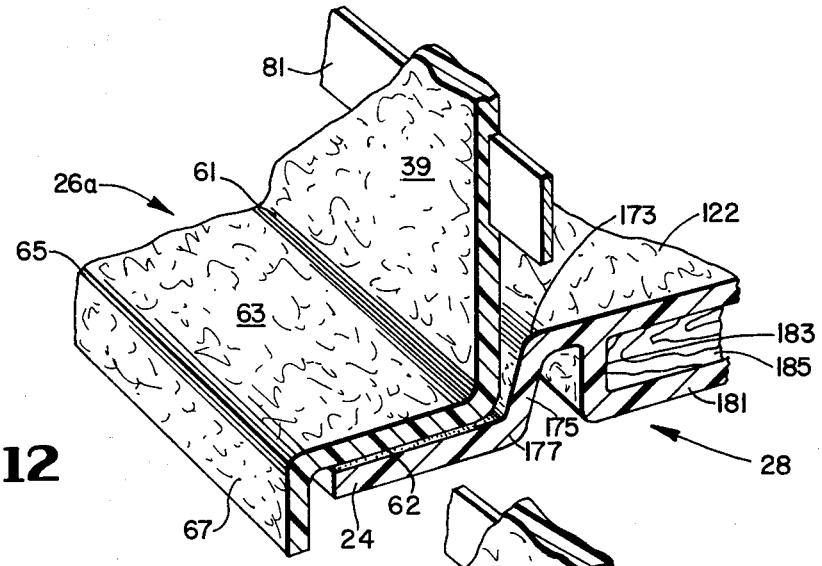
FIG. 12 is a perspective view in section of a bottom knuckle expansion joint or base joint formed by the bottom flanges of curved wall panels of the lowermost ring module and the rim section of the base of the tank shown in FIG. 5.

The modular-construction tank shown in FIG. 5 comprises a base 20, a lower ring module **25*a*, an upper ring module 25*b*, a base joint 28, a circumferential joint 29, and a top 35. The base joint 28 and the circumferential joint 29 are each horizontally disposed and permit movement of upper and lower members. The base 20 is shown as formed of four pie-shaped elements 21. When these are assembled, the base 20 comprises a raised central section 22, a rim section 24, and four recesses 23. The rim section 24 and the central section 22 are connected with a recurved sidewall 175 having bends 173 and 177. The central section 22 may be laid over a concrete pad or may be hollow, as shown in FIG. 12, with a bottom 181 and sides 183 that enclose a filler 185 such as wood, high-density foam, and the like. The base joint 28 has a sealant 62 between ring module 25***a* and rim section 24.

The ring modules 25*a*, 25*b* comprise four curved panels 26 and four compressed butt joints 27 which are vertically disposed. The lower ring module 25*a* also has a discharge port or valve 32 and an inspection hatch or opening 33. Its butt joints 27 fit within the recesses 23 when base joint 28 is formed. The top 35 comprises four wedge-shaped elements 36, four wedge joints 37 therebetween, and a central hatch cover 38. Within practical and utilitary limitations almost any number of panels 26 may form a ring module and any number of ring modules may be vertically tacked upon a base 20, due regard being accorded the strength of materials limitations. For purposes of description herein ring modules will be confined to lower and upper ring modules 25*a* and 25*b*.

Figure 6:
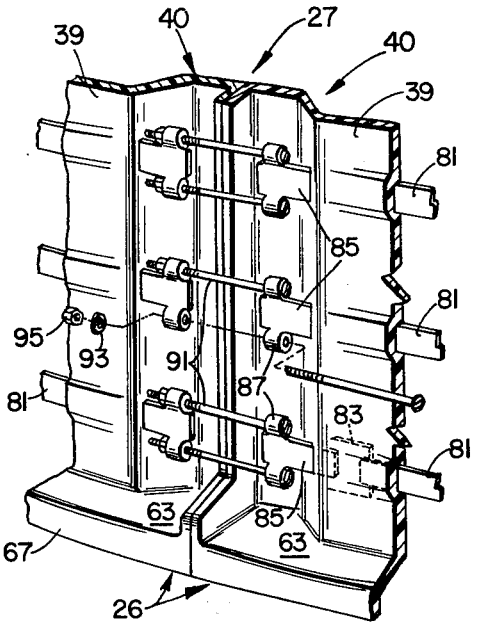
FIG. 6 is a detailed perspective view of a vertical butt joint interconnecting two adjoining curved wall panels of a ring module.
Figure 13:
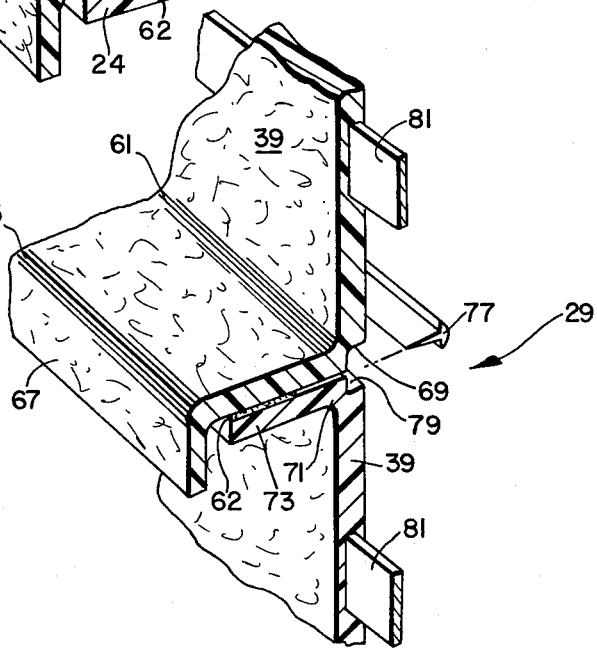
FIG. 13 is a perspective view in section of a circumferential or horizontal joint between two ring modules.

Each curved wall panel 26, as shown in FIGS. 6, 7, 10, and 11, comprise a main wall section 39, a strap assembly 80, and a recurved wall section 40 along each vertical side of section 39. Each recurved wall section 40 is formed by a first partial bend 43, a diagonal 45, a second partial bend 47, a strip 49, a right-angled bend 51, and a flange 53 having a tip 55. Each curved wall panel 26, as shown in FIGS. 6, 12, 13, further forms along its lower end at a right-angle thereto and outwardly extending therefrom a flat brim 63 having a downwardly extending, at a right-angle thereto, lip 67. On the inner side of the juncture of brim 63 with the lower end of the main wall section 39 of all panels 26, except those of lowermost ring module 25*a*, each wall panel 26 has a semi-recess 69. As shown in FIG. 13, each wall panel 26 also has along its top side a flat rim 73, which extends from the main wall section 39 at a right-angle thereto, and another semi-recess 79 in the inner side of the juncture of flat rim 73 with the upper end of main wall section 39.

When a plurality, *n*, of wall panels 26 are conjoined by means of compressed butt joints 27, they form a ring module, for example, ring modules 25*a* or 25*b*. When two or more ring modules are stacked with the top ring panel 73 of a lower module beneath the bottom ring panel 63 of an upper module, a circumferential joint 29 is formed. Within this joint, a sealant 62 of any suitable type known to the art is placed for adhesively conjoining the flat surfaces.

Figure 8:
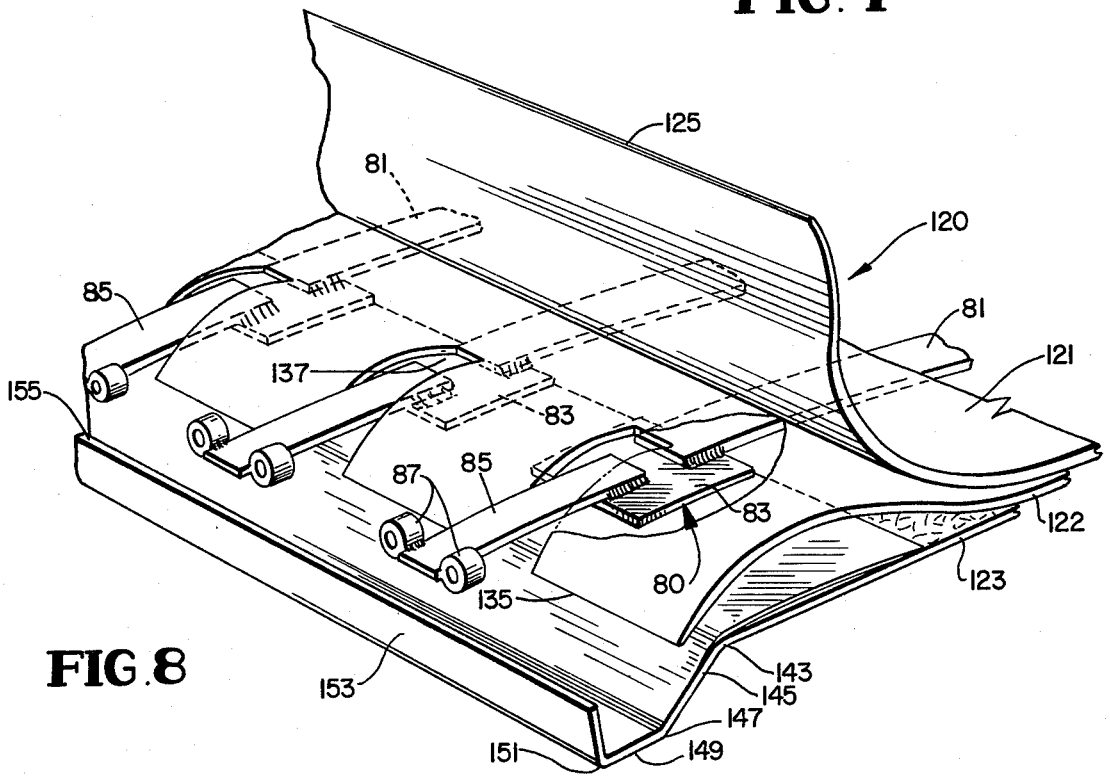
FIG. 8 shows a portion of one vertical side of a curved wall panel for forming a compressed butt joint of this invention by means of separate laminations, as one embodiment of joint and panel construction.

Butt joint 27 comprises a pair of the recurved wall sections 40 of two adjacent curved wall panels 26, a sealant 62 therebetween, a pair of the strap assemblies 80, and an interconnecting means 90. As shown in FIG. 8, the strap assembly 80 comprises an embedded strap 81, a junction plate 83, a point strap 85, and a pair of lugs or eyelets 87 on either side of strap 85, all being rigidly attached, as by welding. The junction plate 83 may alternatively be omitted, so that the embedded strap 81 and the joint strap 85 will be a single continuous strap, designated as joint strap 85. In order to insure strong bonding between the strap and panel the junction plate 83 may be preforated or serrated, and likewise if a continuous strap is used it may be perforated or serrated. The important feature is to provide the strongest possible bond between the strap 81 and panel 26 to prevent delamination and failure of the strap and panel to form a composite having a modulus different from either the panel or strap.

An embedded strap 81 can selectively extend from one side edge to the other side edge of each main wall section 39 as a single, continuous strap. For the lowermost ring module 25*a*, it is indeed desirable to use such a continuous embedded strap 81 because it must withstand the highest hydrostatic pressure. For higher ring modules, however, the embedded straps 81 suitably extend inwardly for merely a portion of the width of the main wall section 39 from each side thereof and are not necessarily continuous. Near the top of the topmost ring module, it is satisfactory for the embedded straps 81 to extend but a short distance away from the bends 43. The straps must be tangentially attached to and embedded within the main wall sections 39 because non-tangential attachment tends to cause delamination of a wall panel 26 when it is subjected to hydrostatic pressure.

The interconnecting means 90 comprises, in combination with the eyelets 87, a bolt 91, a washer 93, and a nut 95, in pairs for each pair of coaxially aligned eyelets 87. Each bolt 91 is inserted into one of the opposed eyelets 87, and a nut 95 is turned thereon to obtain a desired tightness. Each pair of bolts 91 astraddle a joint strap 85 must be tightened equally, as with a torque wrench. Numerous methods may be utilized in interconnecting the straps between conjoint panels 26. For example, the straps could be welded, bolted, or fixed with turnbuckles, etc. Such means are used in such manner as to maintain the butt joints 27 free of tension.

Figure 10:
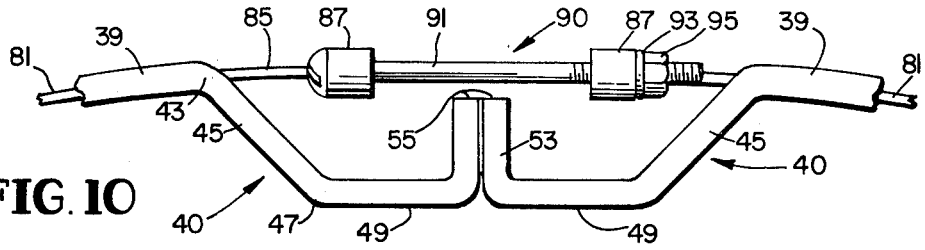
FIG. 10 is a plan view of a compressed butt joint in use in an empty tank.
Figure 11:
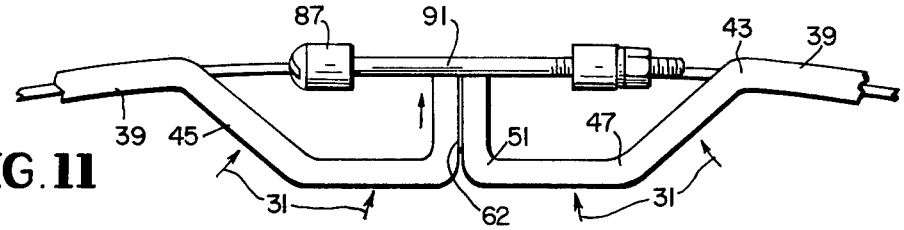
FIG. 11 is a plan view of the compressed butt joint of FIG. 10 after the tank has been filled with liquid to put the joint under hydrostatic load.

Referring to FIGS. 10 and 11, hydrostatic pressure 31 within the tank is exerted perpendicularly to the walls thereof and tends to straighten the pair of inwardly recurved sections 40 of each butt joint 27. The partial bends 43, 47, which are 45° ± 15° bends, thus tend to be diminished by the pressure so that the diagonal 45 and the strip 49 are put in edgewise compression. This pressure is transmitted to the bends 51 and the flanges 53, whereby the sealant 62 is likewise compressed.

Depending upon the amount of bend possessed by the partial bends 43, 47, the flanges 53 tend to move outwardly in direction 34. When a compressed butt joint 27 is initially assembled, a space 59 exists between the flange tips 55 and the sides of the bolts 91, as clearly shown in FIG. 10. When the butt joint 27 is placed under sufficient pressure, however, the flanges 53 move outwardly until the tips 55 contact the sides of the bolts 91, as shown in FIG. 11. Thereafter, as pressure increases, the recurved sections 40 receive support from the bolts 91, whereby compression forces created by hydrostatic pressure 31 within the recurved sections 40 are simply transmitted to and accepted by the interconnecting means 90 so that the compressed butt joint 27, with respect to the potential passageway between flanges 53, can be justly described as an "unloaded joint", i.e., no tensile forces exist in the entire joint area of composite material.

FIG. 8 shows a lamination method for constructing a laminated panel 120 which comprises an outer sheet 121 having an edge 125, a middle sheet 122 having an edge 135 and a slot 137 for accommodating each joint strap 85, and an inner sheet 123 having a first partial bend 143, a diagonal 145, a second partial bend 147, a strip 149, a right-angled bend 151, and a flange 153 with tip 155. Such a laminated panel 120 can be field assembled from flexible sheets of fiberglass-polyester resin which can be cut along edges 125, 135, 155 and slots 137 and glued together with polyester resin gel so that the strap assembly 80 is between the middle sheet 122 and the inner sheet 123.

If desired and particularly if time is pressing, the inner sheet 123 can be molded in the field to the desired dimensions or can be made by postforming a fully cured, C-stage thermoset laminate by heating it over a mold to obtain the desired bends 143, 147, 151, separated by desired diagonal 145 and strip 149 and ending in desired flange 153. The sheets 121, 122, 123 can thus be formed from different polymers and have different reinforcing materials therein.

Moreover, an additional reinforcing layer can be laminated to the inner surface of sheet 123 to cover the inwardly recurved zone from beyond bend 143 to tip 155, whereby this zone can be as strong as the inwardly recurved section 40 of panel 26. Alternatively or in addition thereto, a reinforcing layer can be laminated to the outer surface of the sheet 123 so that it covers the edge 135, beneath the straps 85, and extends to the tip 155.

Figure 9:
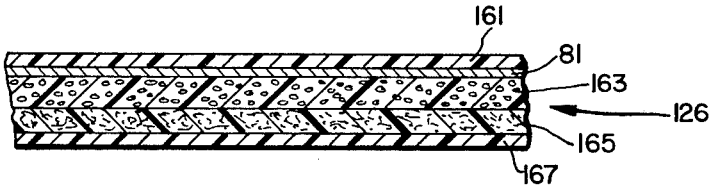
FIG. 9 is a cross-sectional representation of a curved wall panel, constructed as the preferred embodiment from polyester resin, optional polyester foam, chopped fiberglass-polyester gel, and steel straps.

The preferred laminate construction is shown, however, in FIG. 9. This construction is highly suitable for factory manufacture to exact specifications in order to produce the curved wall panels 26, with or without pads or junction plate 83 and with the embedded straps 81 of the strap assembly 80 extending partially inwardly from each bend 43 or the entire width of main wall section 39 of the panels 26.

The laminate 126, as shown in FIG. 9, comprises a gel coat 161, a strap 81, an optional foam layer 163 which may contain some chopped fiberglass, a fiberglass-resin mixture 165, and another gel coat 167. The resin in each of these layers is preferably a polyester but may be any resin that is suitable for the liquid or flowable solid to be stored or processed and that forms a strong bond with the reinforcing agent which is preferably chopped fiberglass. The polyester resin may be combined with a monomer such as styrene, vinyl monomer, alphamethyl styrene, and mixtures thereof. Other resins having possible utility are suitably catalyzed diallyl phthalate polymers, epoxy resins, phenolic resins, silicone resins, vinyl ester and other chemically resistant resins. The polyester resins may be applied to the chopped fiberglass to be bonded according to any manner known to the art, such as spraying, painting or flowing the resins onto a fiber mat to make the mixture 165 and optionally extruding a foam to make the foam layer 163. The laminate 126, as shown in FIG. 9, may utilize fibrous reinforcements other than the chopped type E fiberglass, which is the preferred material. Other suitable reinforcements include, but are not limited to, continuous random mat, specialty classes, such as types S, C and others, and other fibers such as nylons, aromids, graphite or carbon and boron, all used either as randomly oriented short or continuous filaments. Also, naturally occurring fibers such as jute and ramie, and whisker type materials such as aluminas, titanates, sapphires and similar reinforcements may be used.

In constructing a panel 26 having a fitting such as discharge port or valve 32 or inspection hatch or opening 33 therein, embedded straps 81 should pass relatively close above and beneath the fitting or opening in order to receive the full tensile stress delivered thereto by hydrostatic pressure. The stiff materials in the interconnecting system of the compressed butt joints 27, comprising the strap assembly 80 and the interconnecting means 90 must be combined with the flexible materials, such as fiberglass-polyester resin laminate, in such a way that the stiff materials carry the hoop stress concentrically with the circumference of the tank. The flexible materials are thus disengaged from the stiff material at the butt joints 27 and keep the contents of the tank from leaking out but do not carry any hoop-stress (i.e., tensile) load across the butt joints 27.

Figure 7:
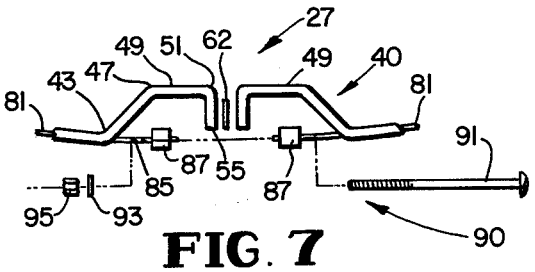
FIG. 7 is an exploded plan view of the compressed butt joint of this invention.

The butt joints 27 illustrated in FIGS. 6 and 7 are formed by recurved wall sections 40 which project inboard of the nominal circumference of the wall panels 26 and ring modules **25*a* and 25*b*, and the straps 81 of strap assemblies 80 are on the nominal circumference thereof. These butt joints 27 could be made with recurved wall sections 40 projecting outboard of the nominal circumference of the wall panels 26 and ring modules 25*a* and 25*b*. The important feature is that the straps 81 are on the nominal circumference of the wall panels 26 and ring modules 25*a* and 25*b*.**

Because it will be readily apparent to those skilled in the art that innumerable variations, modifications, applications, and extension of these embodiments and principles can be made without departing from the spirit and scope of the invention, what is herein defined as such scope and is desired to be protected should be measured, and the invention should be limited, only by the following claims.

What is claimed is:

1. A modular-construction tank comprising:

A. a base; and

B. a ring module which fits sealably upon said base, comprising, in combination:

1. a plurality of curved wall panels which are principally made from a thin-walled material, each comprising:
   - a. a main wall section,
   - b. a strap assembly, and
   - c. a recurved wall section which is disposed along each vertical side of said main wall section, said recurred wall section comprising:
     1. an inwardly disposed diagonal which extends from said main wall section along a first partial bend;
     2. a circumferentially disposed strip which extends from said diagonal along a second partial bend; and
     3. a radially disposed and outwardly extending flange which extends out of said strip along a right-angled bend; and
2. a plurality of butt joints, each comprising:
   - a. a pair of said strap assemblies,
   - b. a pair of said recurved wall sections, and
   - c. an interconnecting means for conjoining and circumferentially compressing said wall panels across said butt joint to form said ring module;

whereby hydrostatic pressure causes said strap assemblies and said interconnecting means to be in tension from hoop stress and said recurved wall sections to be free of tension.

2. A modular-construction tank comprising:

A. a base; and

B. a ring module which fits sealably upon said base, comprising, in combination:

1. a plurality of curved wall panels which are principally made from said materials, each comprising:
   - a. a main wall section,
   - b. a strap assembly said strap assembly comprising a plurality of straps which are circumferentially embedded within each said main wall section and extend alongside and outwardly of each said recurved wall section; and
   - c. a recurved wall section which is disposed along each vertical side of said main wall section, and 2. a plurality of butt joints, each comprising:
   a. a pair of said strap assemblies,
   b. a pair of said recurved wall sections, and
   c. an interconnecting means for conjoining and circumferentially compressing said wall panels across said butt joint to form said ring module;
   whereby hydrostatic pressure causes said strap assemblies and said interconnecting means to be in tension from hoop stress and said recurved wall sections to be free of tension.

3. The tank of claim 2 wherein each said strap embedded within said main wall section is rigidly attached to a junction plate within said panel.

4. The tank of claim 3 wherein a joint strap is rigidly and tangentially attached to each said junction plate and extends toward said each vertical side.

5. The tank of claim 4 wherein a pair of eyelets are rigidly attached to each said joint strap.

6. The tank of claim 5 wherein two pairs of said eyelets are in coaxial alignment across said butt joint.

7. The tank of claim 6 wherein said interconnecting means comprises a pair of bolts and nuts, each said bolt being passed through one said pair of coaxially aligned eyelets.

8. The tank of claim 1 wherein said strap assembly comprises a plurality of straps which are circumferentially embedded within each said main wall section and extend alongside and outwardly of each said recurved wall section.

9. The tank of claim 8 wherein the forces of hydrostatic pressure tends to straighten said recurved wall sections by flattening said partial bends and putting said diagonals and said strips into edgewise compression, whereby said flanges are circumferentially compressed.

10. The tank of claim 9 wherein a sealant is between said flanges and is compressed under said hydrostatic pressure.

11. The tank of claim 10 wherein said sealant is a polyester gel which bonds said flanges together.

12. The tank of claim 11 wherein each said curved wall panel of said ring module comprises along its bottom side a flat brim, which extends outward along its inner edge from said main wall section, and then forms into a downwardly extending lip.

13. The tank of claim 1 wherein said base comprises a central section and a rim section which are connected with a recurved sidewall.

14. The tank of claim 13 wherein said ring module is conjoined to said base by a movement-permitting base joint in which said curved wall panels rest upon said rim section.

15. The tank of claim 14 wherein said ring module comprises along its top side a horizontally disposed flat rim.

16. The tank of claim 14 wherein an additional ring module is vertically stacked, as an upper ring module, atop said ring module upon said base by means of a horizontally disposed and movement-permitting ring joint which comprises said flat rim and flat brim with a sealant therebetween.

17. The tank of claim 16 wherein a top is vertically stacked on the topmost of said ring modules.

18. The tank of claim 17 wherein said thin-walled material are a fiberglass-polyester composite.

19. The tank of claim 18 wherein said composite is a laminate comprising a polyester gel on inner and outer surfaces thereof and a polyester foam layer and a polyester-fiberglass mixture therebetween.

20. A curved wall panel for a tank to be filled with a flowable material, comprising a composite system of steel bands and a fiberglass-polyester laminate, said steel bands being disposed circumferentially therewithin.

21. The panel of claim 20 wherein said fiberglass-polyester laminate comprises a main wall section and a pair of recurved wall sections which are attached to and straddle said main wall section along the vertical sides thereof.

22. The panel of claim 21 wherein said recurved wall sections comprise an inwardly disposed diagonal, a circumferentially disposed strip, and a radially disposed and outwardly extending flange.

23. The panel of claim 21 wherein said laminate comprises at least two thin sheets.

24. The panel of claim 23 wherein said steel bands are between one of said thin sheets, as the outer sheet, and another of said thin sheets, as the inner sheet and as said pair of recurved sections.

25. The panel of claim 27 wherein said laminate comprises a thin polyester resin gel coat as the inner and outer surfaces thereof, a polyester foam layer adjacent to said outer coat, and a mixture of reinforcing fibers and polyester resin between said foam layer and said inner coat.

26. The panel of claim 25 wherein said steel bands are embedded between, and attached to, said outer gel coat and said foam layer.

27. A thin wall curved panel for a tank to be filled with a flowable material, comprising a composite system of straps made from a metal having a predetermined modulus of elasticity under structural loading and a laminate of a reinforced plastic having a modulus of elasticity under loading substantially lower than said metal straps, said straps being disposed circumferentially therewithin and a means for attaching two adjacent of said panels with butt joints such that substantially zero load is carried by the butt joints.

28. The panel of claim 27 wherein said means comprises:
   A. a main wall section;
   B. a pair of recurved wall sections which are disposed inboard of said tank with respect to said main wall section; and
   C. said metal straps which are embedded within said main wall section and pass tangentially therefrom beside said pair of recurved wall sections.

29. The panel of claim 28 wherein said strap assembly comprises a means for attaching an interconnecting means thereto for conjoining said two adjacent panels.

30. The panel of claim 29 wherein said interconnecting means and said metal straps are in tension from said hoop stress and said pair of recurved wall sections are free of tension.

31. The panel of claim 30 wherein said pair of recurved wall sections each comprises a flange at the end thereof, said flanges being side by side, radially disposed, and outwardly extending and each said flange being connected to said main wall section with a pair of partial bends.

32. The panel of claim 31 wherein said partial bends are $45° \pm 15°$.

33. The panel of claim 32 wherein said reinforced plastic is polyester resin reinforced with chopped fiberglass and said metal is steel.

34. The panel of claim 27 wherein said means comprises:
   A. a main wall section;

B. a pair of recurved wall sections which are disposed outboard of said tank with respect to said main wall section; and C. said metal straps which are embedded within said main wall section and pass tangentially therefrom beside said pair of recurved wall sections.

35. The panel of claim 34 wherein said strap assembly comprises a means for attaching an interconnecting means thereto for conjoining said two adjacent panels.

36. The panel of claim 35 wherein said interconnecting means and said metal straps are in tension from said hoop stress and said pair of recurved wall sections are free of tension.

37. The panel of claim 21 wherein said recurved wall sections comprise an inwardly disposed diagonal, a circumferentially disposed strip, and a radially disposed and outwardly extending flange.

38. The panel of claim 37 wherein said laminate comprises at least two thin sheets.

39. The panel of claim 38 wherein said steel bands are between one of said thin sheets, as the outer sheet, and another of said thin sheets, as the inner sheet and as said pair of recurved sections.

40. The tank of claim 19 wherein said strap assembly comprises a plurality of straps which are circumferentially embedded within each said main wall section and extend alongside and outwardly of each said recurved wall section.

41. The tank of claim 40 wherein said embedded strap is attached to and disposed between said outer gel surface and said foam layer.

42. The tank of claim 17 wherein the outer extremity of each said recurved wall section is radially spaced from said bolts while said tank is empty and is outwardly movable by the action of hydrostatic pressure until said outer extremity contacts said bolts, whereby each said recurved wall section transmits said hydrostatic pressure to and receives support from said bolts.

* * * * *